US006004138A

United States Patent [19]

Harbertson

[11] Patent Number: 6,004,138

[45] Date of Patent: Dec. 21, 1999

[54] ELECTRIC OUTLET EXTENDER

[76] Inventor: Grant J. Harbertson, 1952 S. Jeri Dr., Bountiful, Utah 84010

[21] Appl. No.: 08/789,054

[22] Filed: Jan. 28, 1997

Related U.S. Application Data

[63] Continuation-in-part of application No. 08/550,761, Oct. 31, 1995.

[51] Int. Cl.[6] ..... H01R 39/00

[52] U.S. Cl. ..... 439/32; 439/21

[58] Field of Search ..... 439/22, 21, 20, 439/27, 652, 32, 33

[56] References Cited

U.S. PATENT DOCUMENTS 4,245,873 1/1981 Markowitz ..... 439/32
5,399,093 3/1995 Schneider et al. ..... 439/21
5,441,416 8/1995 Gajewski et al. ..... 439/32
5,727,953 3/1998 Pasholk ..... 439/21

*Primary Examiner*—Gary Paumen
*Attorney, Agent, or Firm*—Lloyd W. Sadler

[57] ABSTRACT

An electrical outlet extender with a male plug at one end to be connected into a wall outlet and a female electrical outlet at an opposite end and with one or more tubular members connected between the male plug and the female outlet. The tubular member are connected to each other through a slidable, rotatable or both slidable and rotatable means, thereby permitting the extender to be easily adjusted and adapted to fit the widest variety of electrical extension requirements, while maintaining a desired length and position and while avoiding the drawbacks of coils of standard extension cords

4 Claims, 4 Drawing Sheets

ELECTRIC OUTLET EXTENDER

This patent application is a continuation-in-part of U.S. patent application Ser. No. 08/550,761, which was filed on Oct. 31, 1995 and priority is claimed thereto.

BACKGROUND OF THE INVENTION

1. Field of the Invention

This invention relates to devices to extend the effectiveness of electrical wall outlets. It is particularly concerned with rigid extension devices that effectively move an outlet from a difficult to reach and use location to a convenient location for the coupling of extension cords and electrical devices.

2. Description of Related Art

Extension cords are widely used as devices to effectively extend electrical outlets from a fixed location in a wall to a remote location where an electrically powered device can be attached and used. Such cords are flexible and have a plug on one end to be plugged into a wall outlet and an outlet on the other end of the cord into which a male electrical plug can be inserted. While they may work reasonably well in situations where the cords are allowed to fall as they may, after insertion of the male plug end into a wall outlet and movement of the female receptacle end to a desired location, they are unsightly and in some instances may constitute traffic hazards.

Various special configurations of extension cords have been proposed in the past. Some are intended to prevent the sprawling flexible cord and the hazards associated therewith and others recognize a need to have a flat cord that will extend an electrical wall outlet to a remote location. U.S. Design Pat. No. 324,669, for example, discloses an extension cord with a reel in a housing that will rest against a wall when the cord is plugged into a wall receptacle. A similar retractable extension cord unit is shown in U.S. Pat. No. 3,815,078. U.S. Pat. No. 4,708,094 discloses an extension cord of undercarpet flat cable with a flexible extension and male plug extending from one end of one member of a flat telescoping, conductive assembly, the other telescoping member of which has a female outlet fixed thereto.

There remains a need for a device that will plug into a wall outlet and transmit power from such outlet to a desired location, with the device hugging the wall so as not to be unsightly and constructed to be readily rotated with respect to the wall outlet so that female outlet on the end remote from the male plug can be located directly above or below the wall outlet, to either side of the wall outlet or at any desired angle with respect to the wall plug.

For general background the reader is directed to the following U.S. Pat. Nos.: 3,815,078, 4,875,871, 5,041,002, 5,052,937, 5,067,906 and U.S. Design Pat. No. 324,669, each of with is hereby incorporated by reference in its entirety for the material disclosed therein.

OBJECTS OF THE INVENTION

It is not uncommon that when furniture is positioned in a building electrical wall outlets are hidden behind the furniture. It is also not uncommon that it is often desirable to connect electrically powered devices into the hidden and difficult to reach wall outlet. As previously noted this can be accomplished with the usual flexible extension cords. However, the conventional extension cords are, at best, difficult to use where it is desired that the female outlet of the cord be held in an assigned raised position. For example, a wall outlet positioned behind the head of a bed cannot be easily accessed or the insertion of the plug of a lamp, clock, radio or other electrical device. Such electrical device may be positioned on a table at either side of the head of the bed or may be mounted on or in a headboard of the bed.

Accordingly, it is a principal object of the present invention to provide an electrical outlet extender that will plug into a wall outlet and having a substantially rigid, conductor section that will pivot about the male plug inserted into the wall outlet to position a female outlet at a desired position relative to the wall outlet where the female outlet is conveniently accessed for receipt of the plug of one or more electrical devices.

FEATURES OF THE INVENTION

Principal features of the invention include a first substantially rigid, non-conductive, telescoping (or in an alternative embodiment, pivoting) member having a male plug rotatably mounted on one end thereof and electrically connected to first flat electrical connectors extending the length of the first substantially rigid member.

In one embodiment of the invention, a second substantially rigid, non-conductive, telescoping member telescopes within said first substantially rigid telescoping member and has second flat electrical connectors therein, with sliding contacts projecting therefrom to engage the first electrical connectors in the first substantially rigid telescoping member.

In another embodiment of the invention, a second substantially rigid, non-conductive member is pivotally connected to said first substantially rigid member. Rotatable contacts connect said first and said second substantially rigid members.

In still another embodiment of the invention, a second su

Additional objects and features of the invention will become apparent from the following detailed description and drawings, disclosing what is presently contemplated as being the best mode of the invention

DETAILED DESCRIPTION OF THE INVENTION

Figure 1:
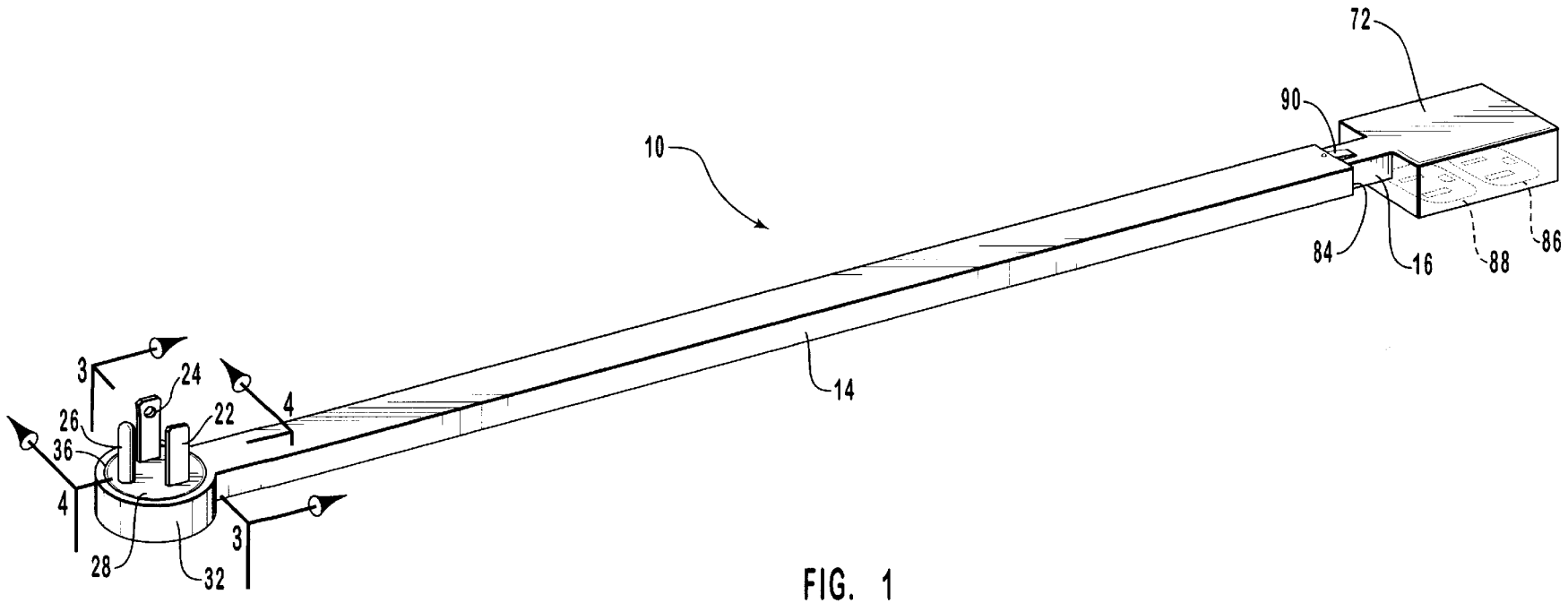
FIG. 1 is a perspective view of the electric outlet extender of the invention
Figure 2:
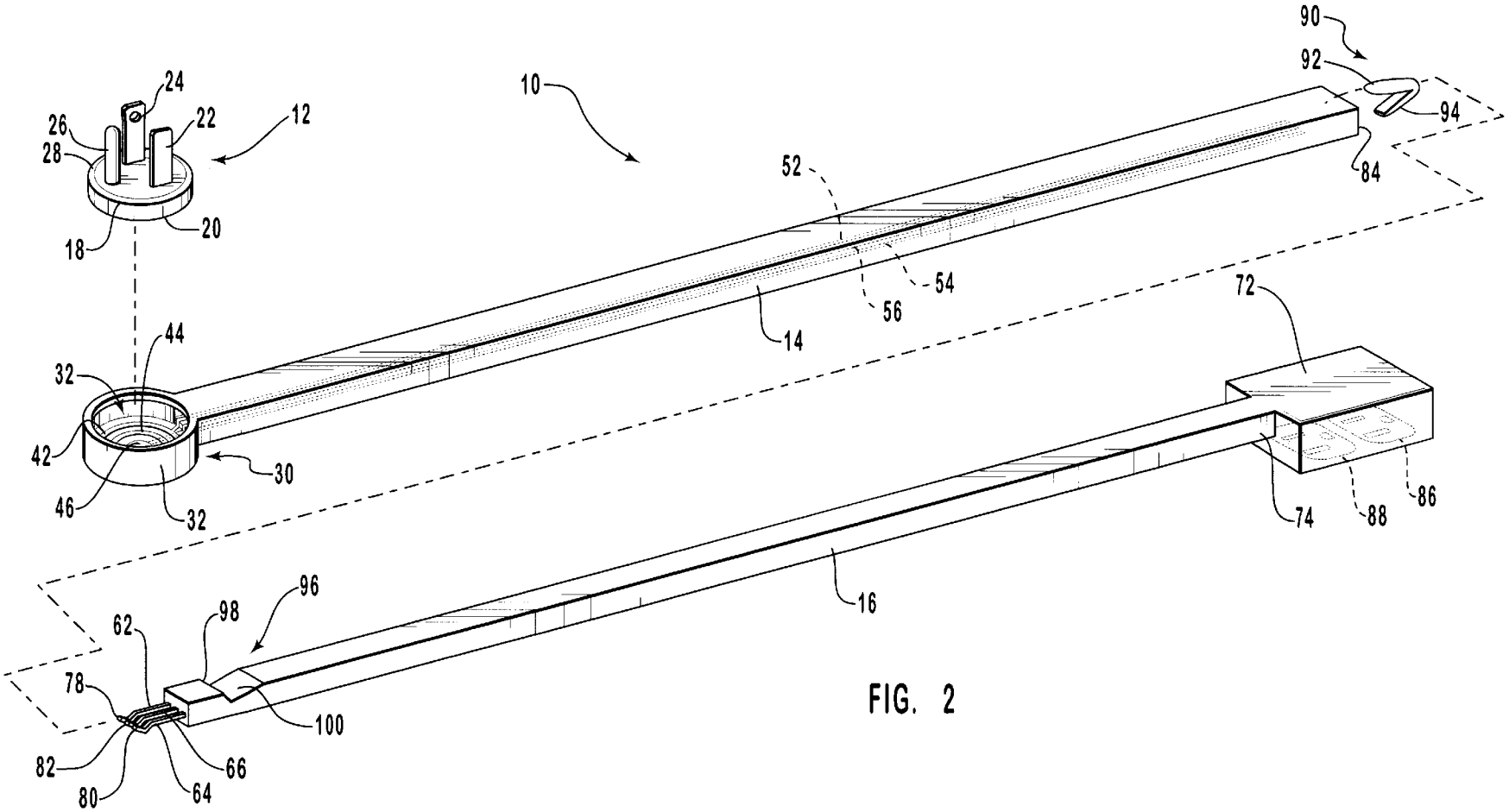
FIG. 2 is an exploded perspective view of the electric outlet extender.
Figure 3:
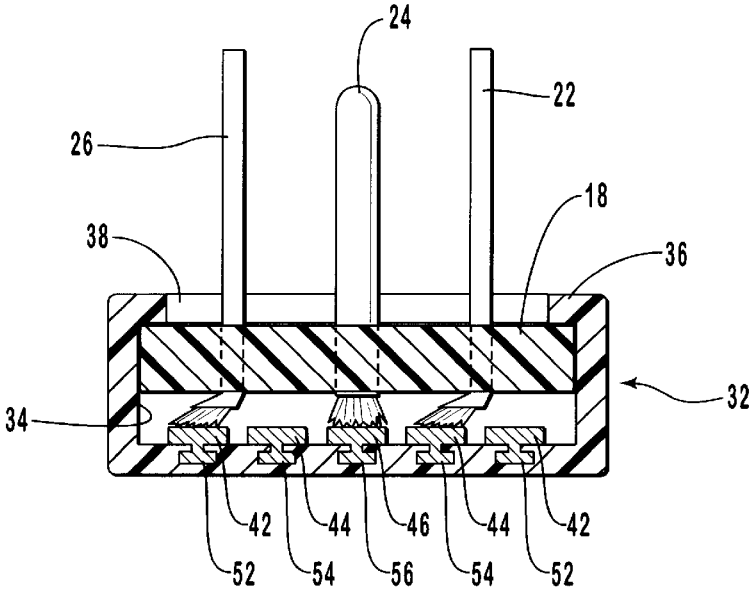
FIG. 3 is a sectional view through the plug of the extender, taken on the line 3—3 of FIG. 1.
Figure 4:
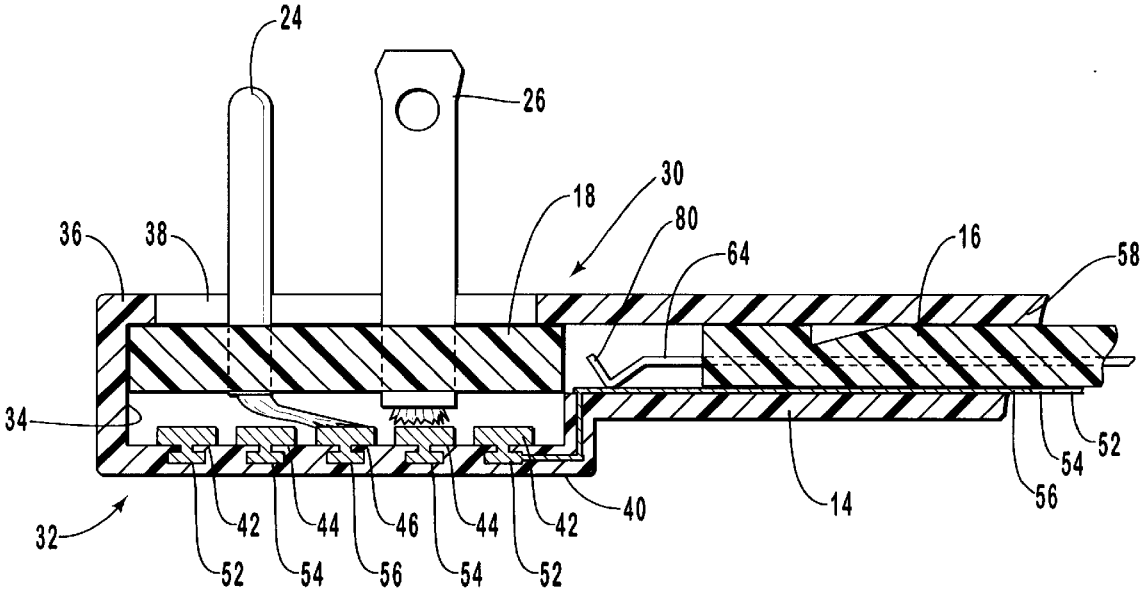
FIG. 4 is a sectional view of the extender, taken on the line 4—4 of FIG. 1.

Referring now to the drawings:

In the illustrated preferred embodiment of the invention, the electric outlet extender is shown generally at 10.

Electric outlet extender 10 includes a male plug assembly 12, a first substantially rigid, non-conductive, tubular telescoping member 14 and a second substantially rigid, non-conductive telescoping member 16.

Male plug assembly 12 has a base 18 with a circular outer periphery 20, molded or otherwise formed from a non-conductive material such as rubber, plastic, composites, or the like. The usual contact prongs 22 and 24 and ground probe 26, such as are commonly associated with male plugs of electrical devices, project from one face 28 of the base 18. The prongs 22 and 24 and probe 26 are embedded in the base 18 and extend through the base to make electrical connections when the plug assembly 12 is snapped into one end 30 of the first electrically non-conductive telescoping member 14.

A socket 32, formed at the end 30 of the first telescoping member 14, has an interior circumference 34 just larger than the outer periphery of the base 18. An inturned lip 36 surrounds the open end 38 of the socket 32.

A bottom 40 of the socket 32 has concentric electrical contact members 42, 44, and 46 molded or otherwise placed therein to be respectively contacted by the contact prongs 22 and 24 and the ground probe 26 when the plug assembly 12 is snapped into the socket 32. Plug assembly 12 is forced through lip 36 and into the socket 32 and is held in place by the lip 36. The plug assembly 12 is rotatable within the socket 32, while maintaining engagement of the prongs 22 and 24 and ground probe 26 with the concentric contact members 42, 44 and 46. The close engagement of the interior circumference 34 with the outer periphery 20 of the base 18 and the pressure applied to the base 18 by the lip 36, while allowing rotation of the plug assembly 12 relative to the socket 32 prevents undesired rotation of the socket 32 and the first telescoping member 14, once they have been positioned with respect to the plug assembly 12.

The concentric electrical contact members 42, 44 and 46 are respectively connected to flat, spaced apart conductor strips 52, 54, and 56 that extend through substantially the full length of a tubular housing 58 of the first telescoping member 14 at one side of the housing 58. The flat strips 52, 54 and 56 are molded into the socket 32 to engage the concentric contact members 42, 44 and 46, without engaging the surfaces of such contact members engaged by the prongs 22 and 24 and probe 26 of the plug assembly 12.

The second telescoping member 14 comprises a solid elongate bar with spaced apart conductors 62, 64 and 66 extending from one end 68 of the bar to a flat outlet housing 72 at the other end 74 of the bar. The conductors 62, 64 and 66 projecting from end 68 each are crimped at 76 to form V-shaped contacts 78,80 and 82. The flat outlet housing 72 has a pair of electrical outlets 86 and 88 molded or otherwise affixed therein and the electrical outlets are each connected to the conductors 52, 54 and 56 in conventional fashion with the outlets 86 and 88 facing opposite to direction of projection of the prongs 22 and 24 and ground probe 26. Alternatively, the outlets 86 and 88 can be positioned so that they away from and at a ninety degree angle from the prongs 22 and 24 and ground probe 26. In this embodiment, no bending of the electrical conductors 52, 54, and 56 is required within the outlet housing 72.

When assembled, the plug assembly 12 snaps into socket 32 and the end 68 of the second telescoping member 14 is tightly be slidably inserted into the end 84 of the tubular first telescoping member 12 with the contacts 78, 80 and 82 respectively engaging the flat conductor strips 52, 54 and 56.

A U-shaped spring clip 90 has one leg 92 fixed to the end 84 of the first telescoping member 12 and another leg 94 extending into the tubular first telescoping where it will engage the second telescoping member 16 as the second telescoping member reciprocates in the first telescoping member. The leg 94 also extends into a groove 96 formed in the end 86 of the second telescoping member 16 and engages an abrupt wall 98 of the notch to prevent withdrawal of the second telescoping member 16 from the first telescoping member 14. The sloped wall 100 of the groove 96 allows the leg 94 to be pulled from groove 96 as the second telescoping member 16 is pushed into the first telescoping member 14.

In use, the prongs 22 and 24 and ground probe 26 are inserted into a wall outlet, the telescoped first and second telescoping members 14 and 16 are rotated about the plug assembly 12 to extend in a desired direction and member 16 is pulled from member 14 to position the outlets 86 and 88 at a desired location to receive the plugs of electrical devices to be powered.

It will be apparent that more than two telescoping members can be provided for the electrical extender 10 of the invention as may be necessary to provide a device capable of reaching a greater range of distances from the wall outlet.

Figure 5:
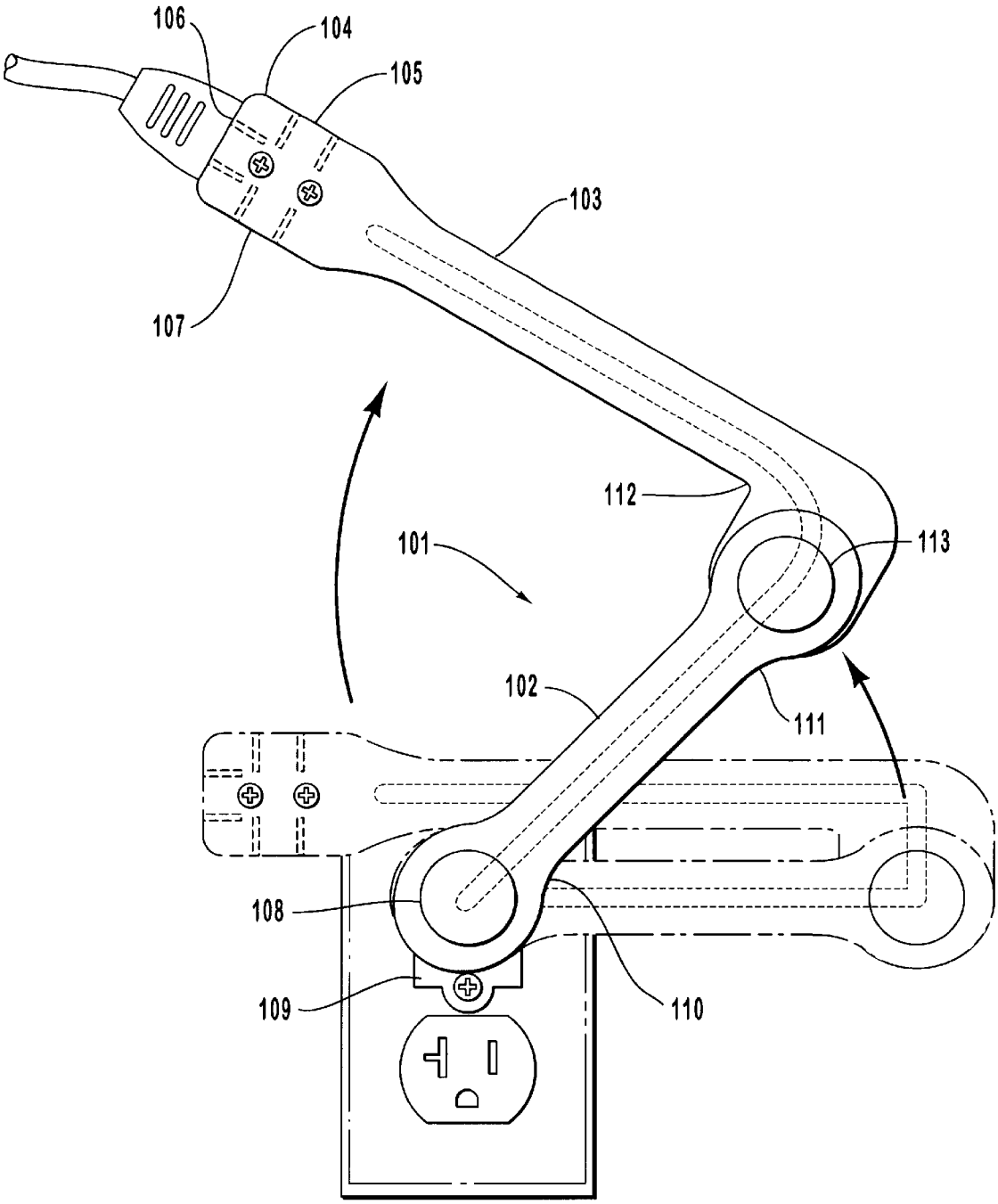
FIG. 5 is an alternative embodiment of the invention, wherein the outlet extender extends itself through pivotally unfolding rather than slidably protruding.

An alternative embodiment of the invention is shown in FIG. 5. In this embodiment of the invention 101, the extension is accomplished by unfolding a plurality of substantially rigid sections about one or more pivot points. A first substantially rigid section 102 is connected at its first end 110 to a male plug assembly 108. This male plug assembly 108 is essentially constructed in the same manner and with the same component elements as previously described 12. The first substantially rigid section 102 has a second end 111 which is connected to a pivot point 113. The pivot point 113 contains a conductor ring substantially similar to the internal construction of the male plug assembly 12. The pivot point 113 is designed to permit retraction, that is positioning of the first and second substantially rigid sections 102 and 103 adjacent and essentially parallel to each other, to fully extended, that is positioning of the first and second substantially rigid sections 102 and 103 so that they form essentially a straight extended outlet extension. The pivot point 113 is frictionally fitted so that it will maintain its position after being set in place. The pivot point 113 is also connected to the first end 112 of a second substantially rigid section 103. The second end 104 of the second substantially rigid section 103 is contains plurality of female electric outlets 105, 106 and 107, each of which is adapted to receive standard electric plugs.

Each substantially rigid section 102 and 103 contains within it a power cable composed of two conductors, insulation and a ground sheathing.

The male plug assembly 108, of this embodiment, is provided with a securing means to attach the outlet assembly 101 to a standard wall outlet. In the preferred embodiment of this embodiment of the invention, the securing means is a common screw, which is screwed into the standard center screw hole of standard wall outlets.

Is should be clear to the reader that although this embodiment of the invention is described with two substantially rigid sections 102 and 103 and a single pivot point 113, additional substantially rigid sections and additional pivot points can be used, thereby providing additional length and flexibility in this invention, while maintaining the ability to fold the substantially rigid sections into a compact area, and to alternatively extend the outlet extender into an essentially straight extender. Similarly, since the sections can be positioned at a broad range of angles about the pivot points, this embodiment of the invention provides exceptional directional flexibility.

Although a preferred form of this invention has been herein disclosed, it is to be understood that the present disclosure is by way of example and that variations are possible without departing from the subject matter coming within the scope of the following claims, which subject is regarded by the inventor as his invention.

I claim:

1. An electric outlet extender comprising:

(A) a plug assembly, including a plurality of electrical prongs projecting from a face of an electrically non-conductive base;

(B) a first substantially rigid non-conductive member, having an interior channel, an electrical conductor within said interior channel, a first end and a second end, wherein said first end is rotatably connected to said plug assembly; and (C) a second substantially rigid non-conductive member, having an interior channel, an electrical conductor within said interior channel, a first end and a second end, wherein said second end of said second substantially rigid non-conductive member includes at least one female outlet, and wherein said electrical conductor of said second substantially rigid non-conductive member is electrically connected to said electrical conductor of said first substantially rigid member;

wherein said second substantially rigid non-conductive member is snugly inserted into said first substantially rigid non-conductive member; and wherein said second substantially rigid non-conductive member is designed to telescope from said first substantially rigid non-conductive member while maintaining electrical connection with said first substantially rigid non-conductive member.

2. An electric outlet extender as recited in claim 1 further comprising a pivot point being mechanically and electrically connected to said first substantially rigid non-conductive member and said second substantially rigid non-conductive member.

3. An electric outlet extender as recited in claim 2 wherein said pivot point frictionally resists motion to hold the relative position of said first and second substantially rigid non-conductive members.

4. An electric outlet extender as recited in claim 1 further comprising a second electrical conductor within said interior channel of said first substantially rigid non-conductive member.

* * * * *